US005289437A

United States Patent [19]

Leuenberger et al.

[11] Patent Number: 5,289,437

[45] Date of Patent: Feb. 22, 1994

[54] CONCEALED DISPLAY

[75] Inventors: Claude-Eric Leuenberger, Carouge; Gaston Schweighauser, Perly-Certoux, both of Switzerland

[73] Assignee: Montres Rolex S.A., Switzerland

[21] Appl. No.: 916,113

[22] PCT Filed: Dec. 13, 1991

[86] PCT No.: PCT/CH91/00267

§ 371 Date: Jul. 29, 1992

§ 102(e) Date: Jul. 29, 1992

[87] PCT Pub. No.: WO91/10795

PCT Pub. Date: Jun. 25, 1992

[30] Foreign Application Priority Data

Dec. 14, 1990 [CH] Switzerland ..... 3973/90

[51] Int. Cl.[5] ..... G04B 19/20

[52] U.S. Cl. ..... 368/37

[58] Field of Search ..... 368/35, 37, 28, 77, 368/223, 80, 224–239

[56] References Cited

U.S. PATENT DOCUMENTS 5,128,578 6/1993 Perucchi ..... 368/37

5,202,858 4/1993 Kanzaki ..... 368/71

FOREIGN PATENT DOCUMENTS 1711898 12/1955 Fed. Rep. of Germany ..... G04B 19/24

2129962 11/1972 France ..... G04B 19/00

278046 1/1952 Switzerland .

*Primary Examiner*—Bernard Roskoski

*Attorney, Agent, or Firm*—Davis, Bujold & Streck

[57] ABSTRACT

A wristwatch with analogue time display comprises a dial with a hatch (19), and a rotatable disc or hoop (10) bearing non-time indications. The disc is arranged in such a way that the indications provided thereon appear in the hatch via an opening provided in said disc and having a size which is equal to the size of each indication. Said opening reveals additional indications provided by an electro-optical display device (30) when said opening (21) coincides with said hatch (19).

11 Claims, 2 Drawing Sheets

CONCEALED DISPLAY

The present invention concerns an analog wristwatch with a window in the face and a rotatable disc or ring bearing information other than time indications, with the disc being designed to display information in the window.

Quartz analog time display watches, that is, watches using hands to show the time and a disc to show the date or day of the week, preferably have the same outward appearance as traditional mechanical watches.

For this type of product it is preferable to adapt and use an electronic movement rather than a mechanical one, as the electronic movement offers improved precision and longevity over the life expectancy of the battery, rather than for the limited number of hours of energy stored in the spring barrel of a mechanical watch. Using an electronic movement gives designers the same freedom as using a mechanical movement and allows a wide variety of product dress without affecting the basic function of time display (second, minute, hour, date, perhaps day of the week, month or year).

The following prior art solutions have been proposed to integrate one or more supplemental features into an electronic analog watch such as a timer, an alarm, or month, year, temperature display, etc.:

adding an electro-optical cell for numeric or alphanumeric display next to the watch face or in a window formed in the face;

placing an electro-optical cell of the same shape as the watch face within the face, said cell having a hole in the center through which the axes of the watch hands may pass.

The disadvantages inherent in these embodiments impose serious limitations upon designers. Electro-optical cells are available in only a very limited number of colors, and their shape as well as the appearance of the display characters can make the product unattractive, particularly for the high fashion market.

To overcome these disadvantages, the watch according to the invention is characterized in that the disc has at least one opening located in the same place as a unit of information supplied thereon and makes supplemental information available when said opening corresponds with the window.

According to a preferred embodiment, the supplemental information is provided by a fixed electro-optical display means.

When the disc carries date information, the size of the opening in the disc preferably corresponds approximately to a 1/32nd rotation.

When the disc is for displaying days of the week, the disc opening size corresponds essentially to a ⅛th rotation.

According to a particularly advantageous embodiment, the disc opening is essentially equivalent in size to the window in the watch face.

The watch according to the invention comprises control means for access to the supplemental information displayed in said opening.

When the watch has a time set stem, said control means preferably consists of the time set stem.

The time set stem on the watch is preferably designed so that specialized manipulations activate the command for displaying supplemental information in said opening.

The control means preferably consists of at least one button.

In another watch embodiment, the control means is automatic and is activated by applying tension when changing the battery.

The present invention will be better understood with reference to the description of one preferred embodiment and one variation thereof, and to the attached drawing, in which.

Figure 1:
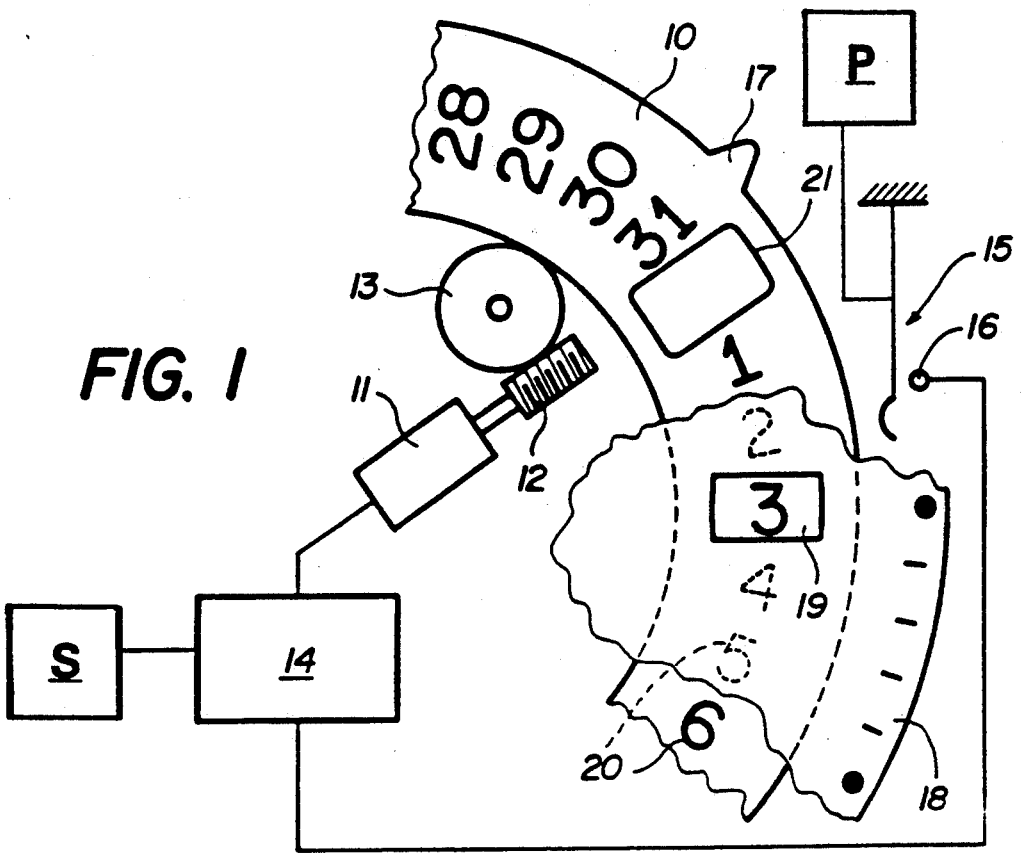
FIG. 1 shows a partial view of the watch according to the invention in which the supplemental information accessible via the disc opening is concealed.

In the embodiments described below with reference to the drawings, a disc displaying the date and/or day of the week is shown, which in one position presents an opening revealing an electro-optical display device, said electro-optical display device being affixed beneath the window in the watch face and beneath the disc. This opening preferably spans a 1/32nd rotation of the date disc, for example, between the thirty-one and the one, or spans a ⅛th rotation by the day-of-the-week disc, for example, between Sunday and Monday. When the opening coincides with the window, a unit of information from the electro-optical display appears. In all other positions this information is concealed by the disc which has either the date numbers or the days of the week on its upper surface, i.e., that surface of which 1/32nd or ⅛th, depending upon the case, is visible through the window. Every position except the position associated with the window corresponds to the conventional display of the date and/or day of the week.

Implementing such a device preferably necessitates some means for angular displacement of the date disc which is independent of the means for displacing the hands. The term "splitting the kinematic chain" in two distinct portions is used. Such an arrangement, known in the art, provides for displacing one or more discs in one direction or another without interfering with time display by the hands, and must take place regardless of the respective positions of the watch hands. A mechanical analog watch with a date or a day of the week disc is always equipped with means for correcting angular position of said disc. As a general rule, this consists of a mechanism connected with the time set stem so that when it is in an intermediate axial position, perhaps extended halfway, one stem rotation causes date-to-date (or perhaps day-to-day) displacement of the corresponding disc. In this case the kinematic chain is also split. There is therefore nothing to prevent addition of an electro-optical display, already described, to a mechanical watch, along with an associated electronic circuit regulating one or more additional functions. One battery must be provided to supply only this portion.

In an electronic watch it is advantageous to provide a means for indexing the position of the disc or discs which, in association with the electronic circuit of the watch, automatically positions the correct value opposite the window. In this case, the circuit actually includes an electronic memory for permanent storage of data relative to the actual position of the disc or discs.

In a simplified version without indexing means, displacing the disc or discs until the electro-optical display appears may be accomplished manually using the time set stem, as in a mechanical watch. This display might provide additional information such as a second time, i.e., the time in another time zone.

In the embodiment which has no indexing system, when the month or week changes, the wearer uses the time set stem to manually advance the position of the disc or discs for a 1/32nd or ⅛th additional turn, respectively, as in the mechanical version, to move from the thirty-first to the first day of the month or from Sunday to Monday and to bypass the disc opening.

The addition of a system indexing position for the disc or discs connected to an electronic circuit controls the automatic advance of the discs and bypassing the disc opening.

Splitting the kinematic chain, as described above, and providing a position indexing system make it possible to achieve a watch know as a perpetual calendar watch. The electro-optical display offers a particularly easy way to program the month and year into the electronic circuit, necessary information for the perpetual calendar function.

Figure 2:
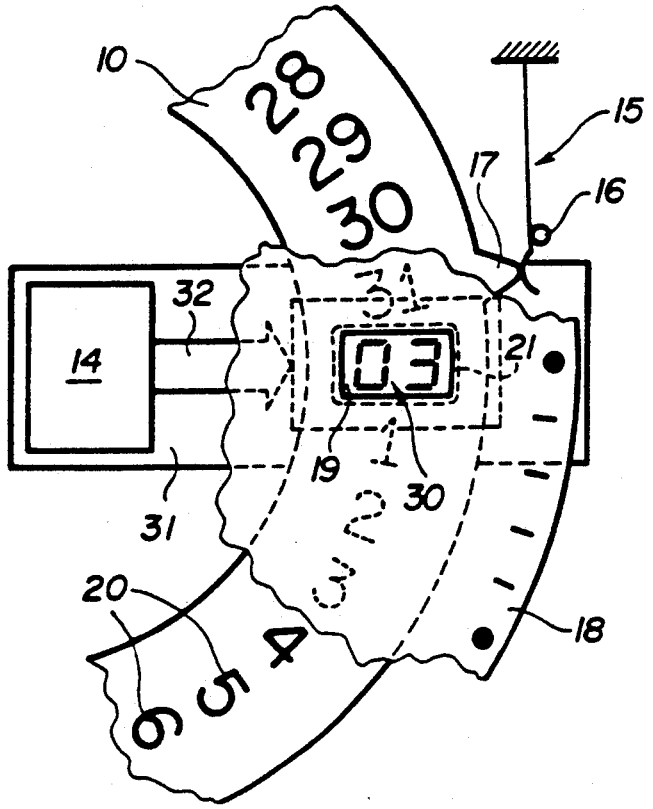
FIG. 2 shows the watch of FIG. 1 with the opening and the window superimposed.

With reference to FIGS. 1 and 2, an electronic watch comprising a kinematic chain for time display (hour, minute and perhaps second hands) driven by a first motor (not shown) comprises a date disc 10 driven by a second motor 11 which may be connected to an endless screw 12 engaging a wheel 13 which meshes with said disc 10 or date ring. The motor is controlled by an electronic circuit 14 connected to a disc position indexing device 15. This device comprises a contact 16 designed to cooperate with a peripheral projection 17 on disc 10.

The watch face 18 is partially shown with window 19. The window dimensions are determined so that the dates 20 printed on disc 10 are visible through the window in their entirety.

Between dates thirty-one and one, the disc comprises an opening 21 essentially the same size as or slightly larger than window 19. As previously described, this opening provides access to the supplemental information located in a fixed position beneath window 19 and which is concealed when the opening does not coincide with the window.

In FIG. 1 three steps separate opening 21 from window 19 by and the supplemental information display is effectively concealed by date disc 10. In FIG. 2, opening 21 coincides with window 19 following the appropriate rotation of the date disc, and display device 30 appears in the window. This device may consist, for example, of an opto-electronic unit which displays the number "03" in the embodiment shown. This device is controlled by electronic circuit 14 attached to printed circuit 31, with electronic circuit 14 being linked to display device 30 by means of an electrical connection shown schematically by arrow 32. In this position contact 16 is closed and transmits the appropriate signal to electronic circuit 14.

According to a preferred embodiment, the supplemental information consists of the number abbreviations for months, but may also consist of any other information, such as ambient temperature, the time in a city in another part of the world, etc.

Figure 3:
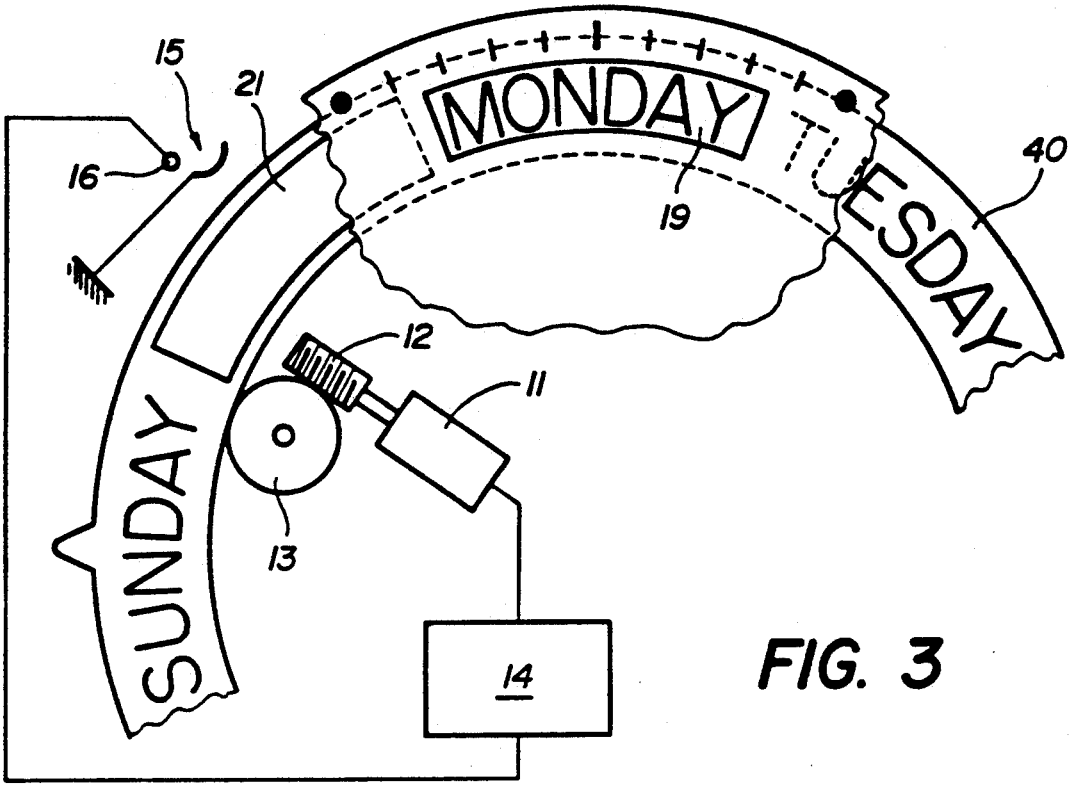
FIG. 3 shows a view of another embodiment with the information concealed.
Figure 4:
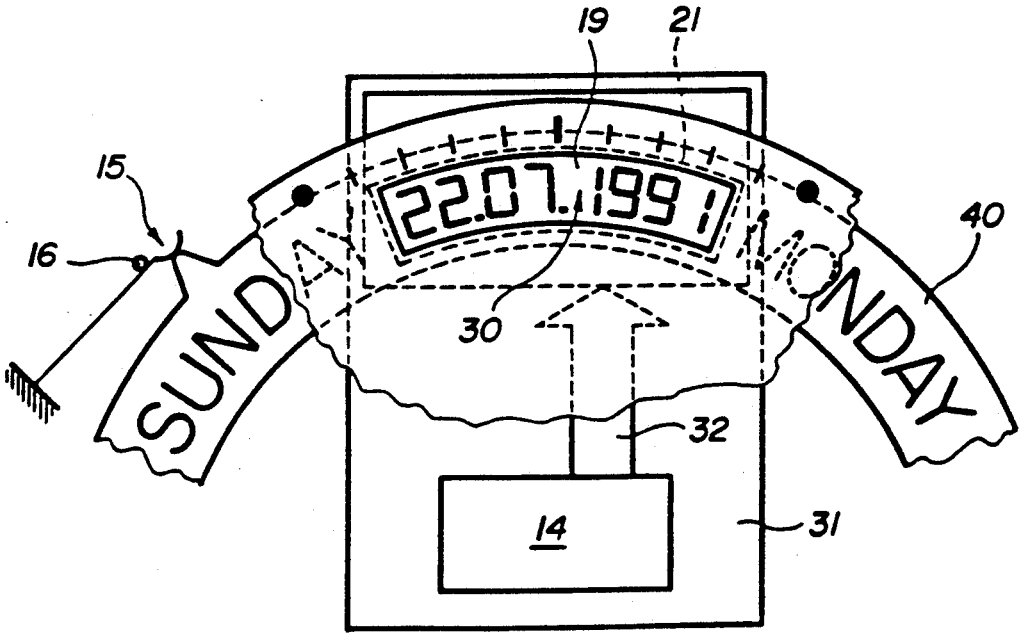
FIG. 4 shows the watch of said other embodiment with the supplemental information displayed through the disc opening and the window superimposed thereon.

FIGS. 3 and 4 show another embodiment in which the date disc is replaced by a day of the week disc. This day of the week disc comprises eight spaces, seven of which bear the names of seven days of the week and the eighth of which corresponds to opening 21. In this case opening 21 is elongate and essentially the same size as a ⅛th rotation of the day of the week disc. Window 19 also extends for the same length as to a ⅛th rotation so that the entire name of the day is displayed. As shown in FIG. 3, the seven days are successively displayed in window 19 and the opening is concealed by the watch face for as long as the days are displayed. Conversely, when the day of the week disc moves to the eighth position, window 19 and opening 21 coincide, thereby giving access to the supplemental information located in a fixed position on the watch case and located beneath window 19.

As shown in FIG. 4, in this embodiment the supplemental information may be an entire date, for example Jul. 22, 1991, visible through window 19 and opening 21.

As mentioned before, this supplemental information may be used for specialized programming of the watch in the case of a perpetual calendar watch. In this case, access to the opening and consequently to the supplemental information display is specifically coded by specialized manipulating of the electronic time set stem, S perhaps in three different positions. Such an electronic time set stem is in effect a contact device which, in association with the electronic circuit of the watch, regulates axial position, rotation and direction of rotation. Such a device is known in the art.

By way of example, when the stem is pushed down, rotation does not occur. This is called the neutral position in which the watch functions normally.

When the time set stem is in intermediate axial position, rotation results in an advance or a decrease of exactly one hour from the hour displayed by the watch hands, depending upon rotation direction.

When the time set stem is in fully extended axial position, rotation controls setting the watch hands for time display.

The electronic circuit is designed to order the motor driving the disc to change the date when the hands reach midnight. When the date changes from the thirty-first to the first, the circuit advances the window positioned between these two dates and the watch works like a conventional watch.

A command must be given to the electronic circuit to reveal the electro-optical display, with the circuit being designed to decode the order and execute the command to displace the date disc until the opening coincides with the window. This command can be given by exerting pressure on a pushbutton, P thereby closing a contact connected to the electronic circuit. However, for the sake of watch appearance, it is preferable not to resort to using a button, but rather to use specialized manipulations of the time set stem. When the stem is in extended position, rotating it five times within several seconds replaces the button function. In this case the electronic circuit comprises appropriate means for recognizing such a manipulation, which puts the watch into programming mode.

When the opening in the date disc coincides with the watch face window, the electro-optical display is activated by the electronic circuit. This display preferably is achieved by the use of an electro-optical cell.

When the stem is pushed down, the current date is displayed. Rotation in one direction causes an increment in date value and thus serves to program the desired date. Rotation in the other direction allows the specialized stem manipulation described above, and the programmed data value is again displayed by the disc.

When the stem is in the middle axial position, the months from "01" to "12" are displayed: one clockwise rotation increases the display value by one (+1), and one counterclockwise rotation decreases the display value by one (−1). In this way the month is programmed.

When the stem is in the extended axial position, the display shows the year in units of tens and ones (for example, 90 for the year 1990). A clockwise or counterclockwise rotation respectively increases or decreases the value displayed. In this way, the year is programmed. When the stem has been pushed back down and the specialized manipulation described above is complete, the electronic circuit commands the disc to return to the programmed position. Once the month and year have been programmed, the electronic circuit is then able to control data disc advancement in accordance with the principles of a perpetual calendar.

When the window is located on the day of the week disc, as shown in FIGS. 3 and 4, the entire date—day, month and year—is displayed directly, thereby facilitating control of the programming operations.

We claim:

1. A wristwatch with analog time display comprising a watch face with a window, said watch face carrying indicia on a first surface thereof and having a rotatable disc supplying information relating to at least one of a day of a week and a date of a month located adjacent a second opposed surface of said watch face, said information being located on a peripheral zone of said rotatable disc and current information concerning at least one of a current day of a week and a current date of a month being displayable through said window in said watch face, wherein said rotatable disc (10) has at least one opening (21) formed therein at a peripheral zone adjacent the peripheral zone carrying said information and supplemental information is displayable via a display device through said opening (21) when said opening (21) coincides with said window (19).

2. A watch according to claim 1, wherein said display device comprises a fixed electro-optical display device (30) located adjacent the second surface of said watch face with said rotatable disc (10) located between said electro-optical display device (30) and said the second surface of said watch face.

3. A watch according to claim 1, wherein said information supplied by said rotatable disc (10) consists of dates of the month (20) and said opening (21) formed in said rotatable disc spans a space substantially equal to a 1/32nd of a rotation of said rotatable disc.

4. A watch according to claim 1, wherein said information supplied by said rotatable disc consists of days of the week and said opening (21) formed in said rotatable disc spans a space substantially equal to a ⅛th of a rotation of said rotatable disc.

5. A watch according to claim 1, wherein said opening (21) formed in said rotatable disc is substantially equivalent in size to said window (19) formed in said watch face.

6. A watch according to claim 1, wherein said watch further comprises control means for programming said supplemental information to be displayed via said display device through said opening.

7. A watch according to claim 6, wherein a time set stem comprises a portion of said control means.

8. A watch according to claim 7, wherein said time set stem, when specially manipulated, activates a command to allow programming of said supplemental information to be displayed via said display device through said opening.

9. A watch according to claim 6, wherein said control means consists of at least one pushbutton for closing a contact to allow programming of said supplemental information.

10. A watch according to claim 6, wherein a motor drives said rotatable disc to display current information concerning at least one of the current day of the week and the current date of the month and movement of said motor is controlled by a programmable electronic circuit (14).

11. A watch according to claim 10, wherein said control means is automatically activated by exerting pressure when changing said battery.

* * * * *